US006047759A

United States Patent [19]

Lysyj

[11] Patent Number: 6,047,759

[45] **Date of Patent: *Apr. 11, 2000**

[54] CORDLESS CELLULAR SHADE

[76] Inventor: Phillip A. Lysyj, 8136 Thornhurst Dr., N. Royalton, Ohio 44133

[ * ] Notice: This patent is subject to a terminal disclaimer.

[21] Appl. No.: 09/353,254

[22] Filed: Jul. 14, 1999

Related U.S. Application Data

[63] Continuation of application No. 09/120,750, Jul. 23, 1998, Pat. No. 5,960,846, which is a continuation of application No. 08/835,310, Apr. 7, 1997, Pat. No. 5,813,447, which is a continuation-in-part of application No. 08/681,910, Jul. 29, 1996, Pat. No. 5,706,876.

[51] Int. Cl.[7] ..... A47H 5/00

[52] U.S. Cl. ..... 160/84.04; 160/171 R

[58] Field of Search ..... 160/84.04, 171 R, 160/84.02, 84.06, 84.03, 107, 98

[56] References Cited

U.S. PATENT DOCUMENTS

| | | |
|---|---|---|
| 13,251 | 7/1855 | Bixler . |
| 927,090 | 7/1909 | Anderson . |
| 948,239 | 2/1910 | McManus . |
| 1,636,601 | 7/1927 | Givens . |
| 1,731,124 | 10/1929 | Carper . |
| 2,037,393 | 4/1936 | Roberts . |
| 2,049,518 | 8/1936 | Schier . |
| 2,110,983 | 3/1938 | Carver . |
| 2,260,101 | 10/1941 | De Falco . |
| 2,266,160 | 12/1941 | Burns . |
| 2,276,716 | 3/1942 | Cardona . |
| 2,324,536 | 7/1943 | Pratt . |
| 2,325,992 | 8/1943 | Wirthman . |
| 2,350,094 | 5/1944 | Butts . |
| 2,390,826 | 12/1945 | Cohn . |
| 2,410,549 | 11/1946 | Olson . |
| 2,420,301 | 5/1947 | Cusumano . |
| 2,509,033 | 5/1950 | Carver . |
| 2,520,629 | 8/1950 | Esposito . |
| 2,598,887 | 6/1952 | Burns . |
| 2,687,769 | 8/1954 | Gershuny . |
| 2,824,608 | 2/1958 | Etten . |
| 2,874,612 | 2/1959 | Luboshez . |
| 3,371,700 | 3/1968 | Romano . |
| 3,485,285 | 12/1969 | Anderle . |
| 3,487,875 | 1/1970 | Shukat et al. . |
| 3,817,309 | 6/1974 | Takazawa . |
| 4,157,108 | 6/1979 | Donofrio . |
| 4,205,816 | 6/1980 | Yu . |
| 4,223,714 | 9/1980 | Weinreich et al. . |
| 4,326,577 | 4/1982 | Tse . |
| 4,344,474 | 8/1982 | Berman . |
| 4,398,585 | 8/1983 | Marlow . |
| 4,574,864 | 3/1986 | Tse . |
| 4,610,292 | 9/1986 | Hausmann et al. . |
| 4,623,012 | 11/1986 | Rude et al. . |
| 4,625,786 | 12/1986 | Carter et al. . |
| 4,647,488 | 3/1987 | Schnebly et al. . |
| 4,726,410 | 2/1988 | Fresh . |
| 4,852,627 | 8/1989 | Peterson et al. . |
| 4,862,941 | 9/1989 | Colson . |
| 4,877,075 | 10/1989 | Markowitz . |

(List continued on next page.)

*Primary Examiner*—David M. Purol
*Attorney, Agent, or Firm*—Frank J. Nawalanic; Steve Zlatos

[57] ABSTRACT

A cordless cellular or pleated window shade having a head rail, a bottom rail and a pleated shade fabric therebetween uses a conventional spring tensioned roller shade bar for raising and lowering the shade without draw cords. A lead screw permanently affixed to an end cap of the head rail threadingly engages one end of the roller shade bar while the opposite end of the roller shade bar has a movable support locking the spring tensioner of the roller shade bar to the support to permit movement of the roller shade bar within the head rail. Lift cords wrap and unwrap themselves about the roller shade bar so that lowering of the shade tensions the spring which spring tension is then used to raise the pleated or cellular shade. The pitch of the lead screw forces the lift cords to wrap themselves about the shade roller bar in a singular, non-overlying manner while the roller shade bar moves within the head rail thereby assuring consistent alignment of the bottom rail with the head rail at any shade position.

7 Claims, 5 Drawing Sheets

U.S. PATENT DOCUMENTS

| | | | |
|---|---|---|---|
| 4,880,045 | 11/1989 | Stahler . | |
| 4,907,635 | 3/1990 | Bunger et al. . | |
| 4,984,617 | 1/1991 | Corey . | |
| 5,083,598 | 1/1992 | Schon . | |
| 5,133,399 | 7/1992 | Hiller et al. . | |
| 5,141,041 | 8/1992 | Katz et al. . | |
| 5,228,491 | 7/1993 | Rude et al. . | |
| 5,313,998 | 5/1994 | Colson et al. . | |
| 5,320,154 | 6/1994 | Colson et al. . | |
| 5,445,204 | 8/1995 | van der Wielen . | |
| 5,482,100 | 1/1996 | Kuhar . | |
| 5,485,875 | 1/1996 | Genova . | |
| 5,813,447 | 9/1998 | Lysyj | 160/84.04 |
| 5,960,846 | 10/1999 | Lysyj | 160/84.04 |

(PRIOR INVENTION)

(PRIOR INVENTION)

(PRIOR INVENTION)

CORDLESS CELLULAR SHADE

This patent application is a continuation of application Ser. No. 09/120,750 filed on Jul. 23, 1998, now U.S. Pat. No. 5,960,846, and incorporated herein by reference, which, in turn, is a continuation of Ser. No. 08/835,310 filed on Apr. 7, 1997 now U.S. Pat. No. 5,813,447, which, in turn, is a continuation-in-part of application Ser. No. 08/681,910 filed Jul. 29, 1996, now U.S. Pat. No. 5,706,876.

This invention relates generally to window shades and more particularly to window shades where the window covering is a pleatable fabric, such shades conventionally referred to as cellular and/or pleated shades.

The invention is particularly applicable to and will be described with specific reference to a manually operable, cordless mechanism for raising and lowering cellular and pleated window shades. Those skilled in the art may recognize that the invention may have broader applications and, conceivably, could be used in applications where a motorized drive is used, or depending upon the shades spring mechanism, the invention could be applied to shades other than those have a pleatable fabric.

BACKGROUND OF THE INVENTION

Manually operated, window shades or coverings presently in wide scale commercial use can be classified as either cord type or cordless.

Cord type arrangements are universally used today to operate Venetian blinds, cellular shades, pleated shades, thermally insulated shades, Roman and balloon type shades. In all of these shade arrangements, no less than two cords (or a single looped cord) hang from the side of the shade and extend into a head rail which carries some form of pulley arrangement. The pulley arrangement attaches to a set (typically two or three) of draw cords or strings which extends through openings in the blind or shade and attaches to the bottom rail. Pulling the side cords shorten the draw strings so that the bottom rail draws against the head rail and in the process folds or pleats the shade or blind. Lateral movement of the side cords locks and unlocks the pulley so that the weight of the shade or blind will cause the shade or blind to lower. If the lower rail is uneven, pulling one of the side cords shortens one of the draw strings to bring the bottom rail even. (Venetian blinds typically have a wand on the opposite side of the head rail and additional draw strings so that rotation of the wand causes the individual slats to open or close.) An inherent advantage in cord type shades is that the length of the shade can be accurately sized to the length of the window opening. This prevents the shade from bunching or gathering in a folded condition when the shade is fully drawn to span the window openings.

There are numerous lock and clutch mechanisms used with cord shades, and many clutch mechanisms utilize springs to assist in raising or lowering the shades. Examples of such systems may be seen in U.S. Pat. No. 4,623,012, issued Nov. 18, 1996 to Rude et al and U.S. Pat. No. 5,228,491 issued Jul. 20, 1973 to Rude et al. In cord operated mechanisms for window coverings, the lift or ladder cords and, in some applications, the draw cords also are either wound about a stationary capstan or a laterally moving capstan. The laterally moving capstan offers the advantage of wrapping the cords in a single layer. There are numerous mechanisms for winding the cords about a stationary capstan and numerous mechanisms for laterally moving the capstan.

Even though mass production techniques have reduced the price, the cord type arrangement is relatively expensive and typically requires installation by trained installers. The cords hanging down from sides of the shades are aesthetically unpleasing, especially so in window installations where several windows are adjacent one another. The most serious drawback, however, is the safety hazard caused by the dangling cords. The industry has recognized this problem as evidenced by U.S. Pat. No. 5,133,399 to Hiller et al, U.S. Pat. No. 5,485,875 to Genova and the earlier U.S. Pat. No. 3,485,285 to Anderle. Recently, voluntary safety standards for eliminating or reducing the potential strangulation hazzards posed by looped window treatment cords have recently been adopted by The Window Covering Manufacturers Association and approved by the American National Standards Institute.

The old fashioned, conventional roller shade bar window shade is universally accepted as the cordless window shade of choice It is low cost and installed by the homeowner or end user and does away with the problems of a cord. Because the shade must roll onto itself over the roller shade bar, it can not be used for Venetian blinds, cellular shades, pleated shades thermally insulated shades, Roman and balloon type shades. Furthermore, many of these applications have window covering weights which exceed the spring tension generated by conventional roller shade bar springs. In fact, because of this limitation, cord drawn shades with spring assisted clutches have been developed.

Nevertheless, the prior art has attempted to develop cordless applications for such shades. The cordless prior art can be viewed as falling within one of three different design approaches or classifications.

In the first approach, spring or motor driven pulley arrangements are arranged at the sides of the shades or outside the head rail of the shade. The shades are basically raised and lowered by rollers in tracks mounted on the side of the window not entirely dissimilar to how a garage door opens and closes. See for example U.S. Pat. No. 5,141,041 to Katz et. al; U.S. Pat. No. 4,880,045 to Stahler and U.S. Pat. No. 4,862,941 to Colson. For side guides see also, U.S. Pat. No. 4,625,786 to Carter et. al; U.S. Pat. No. 4,398,585 to Marlow; U.S. Pat. No. 2,325,992 to Wirthman and 948,239 to McManus. In U.S. Pat. No. 2,324,536 to Pratt a spring on the support rod provides tension for raising and lowering the Venetian blind by moving the bottom rail through tapes outboard of the slats contained in enclosed side columns. In this approach, the side rails simply make such devices cost prohibitive and unwieldily except for special applications.

The second approach can be summarized as using a spring to wrap the shades lift cords about a sheave mounted in the head rail. One variation of this design approach is disclosed in U.S. Pat. No. 5,482,100 to Kuhar. The concept is perhaps best illustrated in U.S. Pat. No. 3,487,875 to Shukat et al which discloses a roller bar drawing lift cords about sheaves. Wrapping lift cords about themselves will not maintain the bottom rail parallel with the head rail. Earlier designs are disclosed in U.S. Pat. No. 2,037,393 to Roberts; U.S. Pat. No. 2,266,160 to Burns; U.S. Pat. No. 2,276,716 to Cardona; and U.S. Pat. No. 2,824,608 to Etten. The earlier references disclose Venetian blinds having a conventional ratchet pawl spring mechanism in which a cord or a thin tape within the ladder tapes straddling the slats are would onto a sheave attached to the roller bar for raising and lowering the blind. In Letten the cord is outboard. In Roberts the ladder tape itself is wound through pulleys onto the rod and the ladder tape has notches for engaging a mechanism for changing the vertical orientation of the slats held by the ladder tape. The weight of the slats of Venetian blinds, even considering today's light weight mini-blind materials, make the choice of a conventional, ratchet/pulley spring mechanism unacceptable. To obtain a sufficiently strong spring which can be inserted inside a conventional roller shade bar, the diameter of the bar has to be significantly increased. Increasing the diameter of the roller bar means the head rail depth has to be increased accordingly and the resulting aesthetics would not be acceptable in today's home market. Apart from aesthetic considerations, the prior art devices could not maintain the bottom rail consistently parallel with the roller shade bar during repeated operation of the blind. In today's market a variation in alignment of the bottom rail as little as ¼ inch in a shade having a width as short as 36 inches will not be tolerated. While the prior art devices could probably achieve this alignment, initially, inevitably misalignment caused by repeated shade use, will occur. Further, should the bottom rail move out of alignment, there is no way to adjust the blind to bring the bottom rail into alignment.

In the last category of spring drawn shades are those in which the shade bar transversely moves within the head rail to cause the lift cords to wrap and unwrap about a capstan as the shade is lowered and raised. U.S. Pat. No. 5,133,399 to Hiller et al shows such an arrangement in which the lift cords are spirally wound onto cone shaped capstans with spiral grooves formed therein. As the lift cords are wrapped into the grooves, the shade bar, which is mounted onto a platform within the head rail, laterally moves with the platform within the head rail. Significantly, the size of the cone shaped capstan and the tension of the spring are selected to counterbalance one another so that the spring tension maintains the shade at any drawn position of the shade. While it is doubtful that the calibration between spring and capstan can be maintained, the size of the cone shaped capstan coupled with the mounting arrangement will result in an excessively large head rail deemed unacceptable in today's market.

SUMMARY OF THE INVENTION

It is a principle object of the invention to provide a window shade having a pleatable, expandable fabric shade which utilizes a conventional roller shade bar spring and tensioner for drawing the shade which can be precisely cut to a desired window length.

This object along with other features of the invention is achieved in a cordless shade for a window opening which includes a head rail containing a roller shade bar. The roller shade bar has at one end thereof a spring and a conventional spring tensioning mechanism for tensioning the spring upon shade bar rotation in one direction and releasing the spring tension upon opposite shade bar rotation with the releasing of the spring force accomplished by applying a manual force rotating the shade bar in the tensioning direction. A bottom rail to be raised and lowered relative to the top rail is provided along with the shade fabric extending between the head and bottom rails for covering the window. The shade fabric has a cross sectional configuration which is collapsible into folded plies when the shade is raised and extendible to a first position when the shade is fully lowered and further extendible to a second position when the shade is to be raised after being fully drawn. At least first and second longitudinally spaced openings extend through the fabric from the bottom to the top of the fabric and at least two lift bands secured to the bottom rail and extending through the fabric openings are provided for raising and lowering the bottom rail relative to the top rail. An attachment mechanism is provided for securing the lift bands to the roller shade bar so that the lift bands wrap about the roller shade bar as the shade is raised and lowered providing not only a cordless shade but also one which permits the shade fabric to have a length precisely fitting the window opening when the shade is fully drawn thereby avoiding the presence of folded fabric plies at the bottom rail of a fully drawn shade.

1) The Parent Invention

In accordance with the prior invention disclosed in my parent application, (Ser. No. 681,910, filed Jul. 29, 1996, which is incorporated by reference herein and made a part hereof the lift bands comprise tapes having openings formed at increasing incremental distances along the length thereof. The attachment mechanism included a gear tooth or spoke arrangement protruding from the roller bars which precisely engage the tape openings to ensure even, consistent wrapping and unwrapping of the tape about the shade roller bar as the shade is raised or lowered thus maintaining perfect alignment of the bottom rail with the head rail.

2) The Present Invention

In accordance with the present invention, the support bands are cords and the attachment mechanism includes a translating mechanism affixed to a first end of the roller shade bar for moving the roller shade bar longitudinally within the head rail in a first direction upon clockwise rotation of the roller shade bar and in a second opposite longitudinal direction upon counterclockwise rotation of the roller shade bar. A support mechanism is provided at the opposite second end of the roller shade bar for supporting the opposite end of the roller shade bar in a moveable manner while permitting the spring tensioning mechanism to tension the spring and release the spring tension upon lowering and raising the bottom rail. As in my prior invention, the present invention thus provides a cordless window shade in which the shade fabric can be precisely sized to the window opening without excessive fabric bunching when the shade is fully drawn.

In accordance with an important feature of the present invention, the translating mechanism includes a threaded rod or lead screw, non-rotatably affixed to a head rail end cap and the rod threadingly engages the first end of the roller shade bar whereby rotation of the roller shade bar causes longitudinal movement of the roller shade along the threaded rod established by the pitch of the threaded rod which is set relative to the roller shade diameter to assure that the lift cords are spirally wound about the roller shade bar in a non-overlying manner thereby maintaining the bottom rail consistently even with the head rail at any shade position.

In accordance with another important feature of the present invention, the opposite end of the roller shade bar includes a tang extending from the spring tensioning mechanism and the support mechanism includes a support bracket movable along the bottom of the head rail and having a slotted opening through which the tang extends so that the second end of the roller shade bar not only follows the shade bar's first end driven by the lead screw, but also provides a firm mounting arrangement preventing dislodgment of the roller shade bar within the head rail should the shade be forcibly drawn no matter where the bottom rail is pulled.

It is thus an object of the invention to provide a cordless shade in which a light weight shade fabric is folded into plies and nested between the head rail and the bottom rail and the mechanism for raising and lowering the shade, because of its light weight, is a conventional, spring tensioned, roller shade bar.

Another object of the invention is to provide a cordless window shade which utilizes a conventional spring tension roller shade bar mechanism which maintains the bottom rail consistently straight with the head rail at any position of the shade and despite repeated usage and abuses which the shade might be subjected to.

Yet another object of the invention is to provide a cordless window shade in which the head rail has a low profile and particularly a depth, not greater than that of cord drawn shades, permitting universal application for conventional, residential and commercial window frames.

Still another general object of the invention is to provide a cordless window shade which is aesthetically pleasing.

Still yet another object of the invention is to provide a cordless window shade in which the entire mechanism for raising and lowering the shade is contained within the head rail which can be easily mounted within a window frame permitting direct sales of such shades to the consuming public.

Another specific but important object of the invention is the provision of a cordless window shade in which lift cords are used to raise and lower the shade thereby minimizing the openings through the shade which is raised or lowered by means of a conventional spring tensioned roller shade bar.

Still another specific object of the invention is to provide a cordless window shade using a conventional spring tensioned roller shade bar mechanism to raise and lower the shade in which the lift cords are singularly but tightly wrapped in a non-overlying manner about the shade bar thus minimizing the movement of the roller shade bar within the head rail to permit application of the roller shade bar to smaller windows than what otherwise could be possible.

Another specific object of the invention is to provide a cordless window shade which is raised and lowered by a conventional spring tensioning device affixed to the roller bar about which lift cords are attached and which can adjust the positioning of the lift cords on the roller bar to insure that the bottom rail is even with the head rail or readjust the shade after installation to insure the bottom rail is maintained even with the head rail.

A general object of the invention is to simply provide a low cost and reliable shade.

These and other objects of the invention will become apparent to those skilled in the art upon reading and understanding the Detailed Description of the Invention set forth below.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE INVENTION

Figure 1:
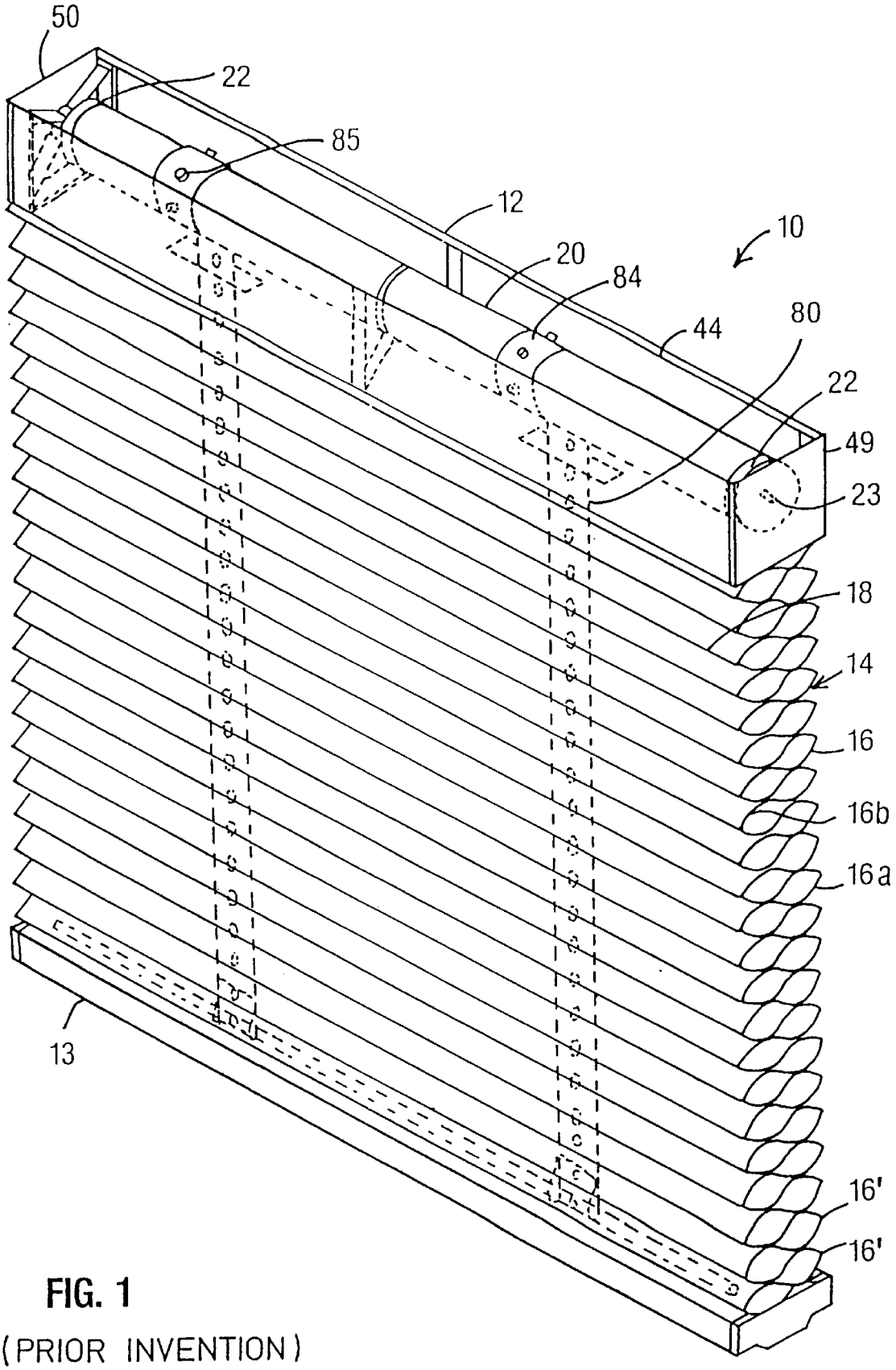
FIG. 1 is a perspective view of a cordless shade illustrating the lift mechanism of the parent invention.
Figure 2:
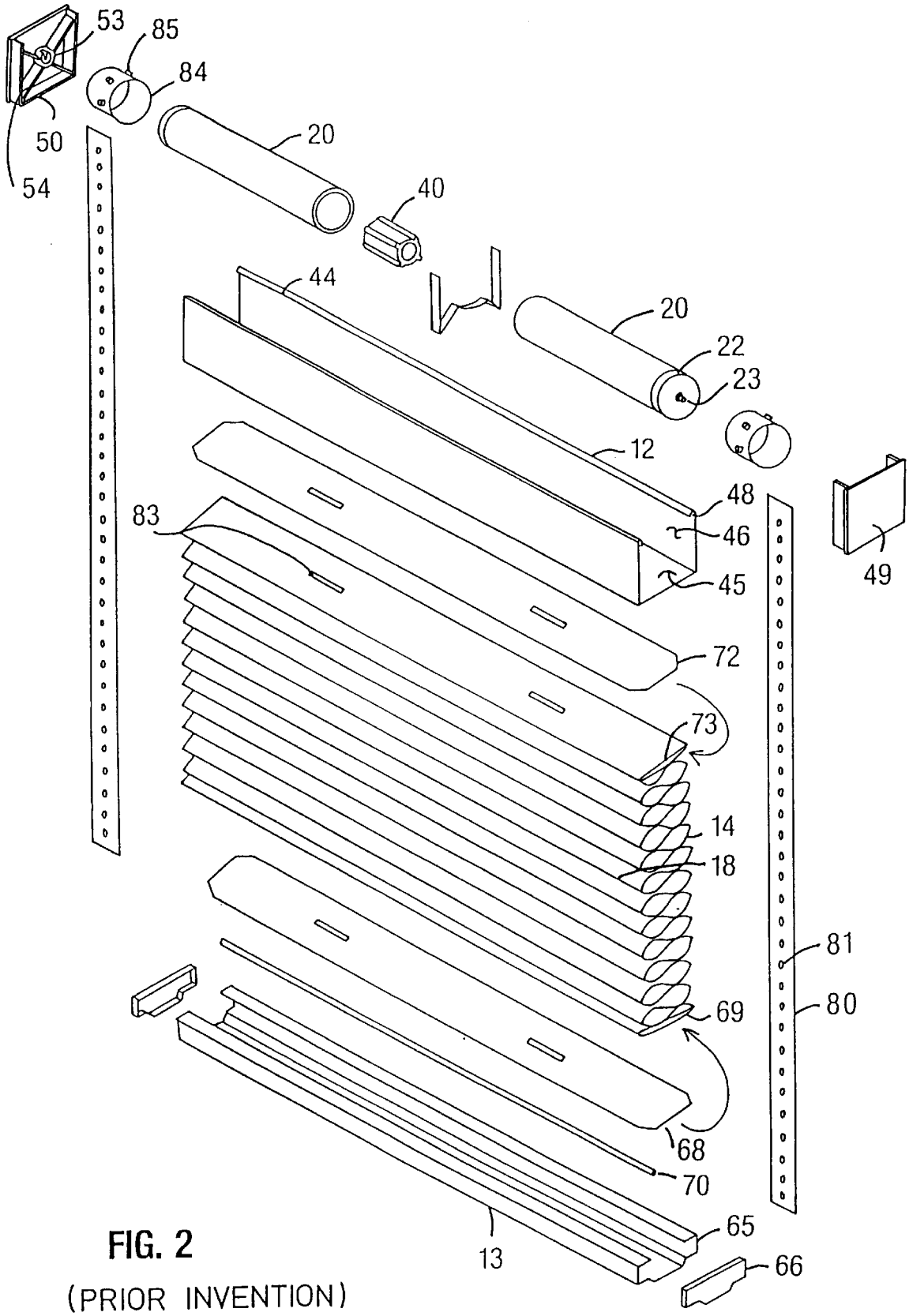
FIG. 2 is a perspective, exploded view of the lift mechanism of the parent invention.
Figure 3:
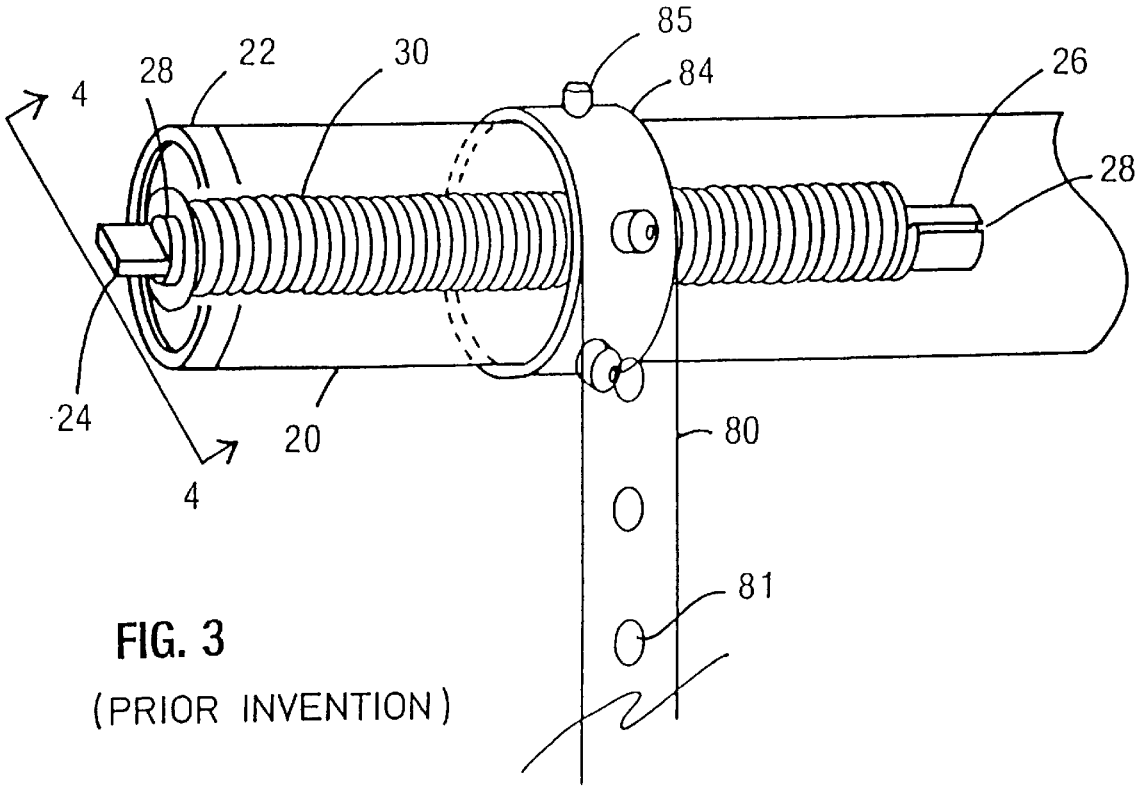
FIG. 3 is a partial schematic illustration showing the tape lift structure of the parent invention.

Referring now to the drawings wherein the showings are for the purpose of illustrating a preferred embodiment of the invention only and not for the purpose of limiting same, the present invention may perhaps be best understood by first referring to the parent invention which is illustrated in FIGS. 1–3. Reference may be had to my parent application, Ser. No. 681,910, filed Jul. 29, 1996, for a more detailed explanation of the parent invention than that set forth herein.

Referring now to FIGS. 1–3, there is shown a cordless shade 10 which generally comprises a head rail 12, a bottom rail 13 and a shade fabric 14 disposed between head rail 12 and bottom rail 13.

One of the underpinnings of the invention resides in the selection of a particular shade fabric 14 for use in cordless shade 10 which is characterized in that shade fabric 14 i) is lightweight and ii) has a cross sectional configuration which is collapsible when the shade is raised and extendible to a first position when the shade is fully lowered and further extendible to a second position when the shade is to be raised after being fully drawn. In FIG. 1, shade fabric 14 is a cellular shade and can be viewed as comprising, in cross sectional configuration, a plurality of polygonal cells 16 interconnected to vertically stack one on top of the other to form a honeycomb pattern as illustrated when shade 10 is drawn or lowered so that shade fabric 14 covers the window (not shown). More specifically, when shade 10 is retracted, polygonal cell shape 16 collapses to form fabric plies indicated by transversely extending lines 18 in FIGS. 1 and 2. Thus, the honeycomb pattern formed in polygonal cell shape 16 expands and contracts like an accordion so that when shade fabric 14 is retracted, shade fabric 14 comprises a series of vertically stacked plies 18 and when shade 10 is drawn, shade fabric 14 comprises a honeycomb matrix of polygonal cell shapes 16. (For cellular shade fabric 14 shown in FIGS. 1 and 2, there are two rows of polygonal shapes designated as 16*a*, 16*b* which make the arrangement preferred for the parent invention but which are not necessary.) In the drawings of FIG. 1, shade 10 is fully drawn and the polygonal cells 16 are extended to their normal first position. When the shade is to be raised, a further downward of bottom rail 13 is normally required to activate a conventional roller shade bar spring mechanism. The polygonal shapes 16 allow this further downward motion to occur and simply distort themselves in a vertical direction so that the shade can be raised from a fully drawn position such as shown in FIG. 1. Thus, shade 10 can be perfectly sized to cover the window opening in that the bottom most cells, shown as 16', can be extended in a vertical direction to about the same extent as the rest of the cells in the shade. The shade of the present invention is thus not bunched or gathered with nested plies resting on top of bottom rail 13 when the shade is fully drawn. If polygonal cells 16 could not expand from the shade's fully drawn position, additional plies 18 would have to be provided in the shade (such as would occur for a Venetian blind or a roman shade) which is aesthetically unappealing to the consumer. This concept of an expanding cell is also applicable to pleated shade fabrics as shown for the present invention in FIG. 6.

Within head rail 10 is a totally conventional roller shade bar 20. The prototype was constructed using a standard 1⅛ inch diameter by 55½ inch length hollow, soft wood window shade roller purchased for $1.99. Roller shade bar 20 is furnished with end caps 22 and from one end cap extends a support tip stud 23 and from the other end cap extends a support tang 24. In fact, roller shade bar 20 in the preferred embodiment is a bar constructed of convoluted paper.

Figure 4:
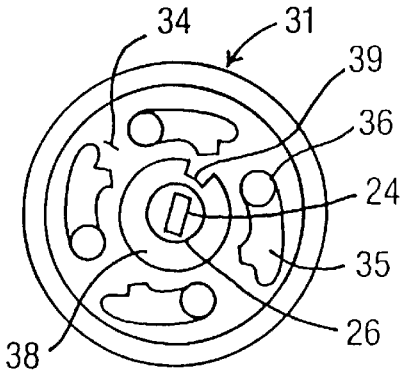
FIG. 4 (PRIOR ART)
FIG. 4 is a schematic representation of a ratchet pawl mechanism taken along line 4—4 of FIG. 3 and is prior art.
Figure 5:
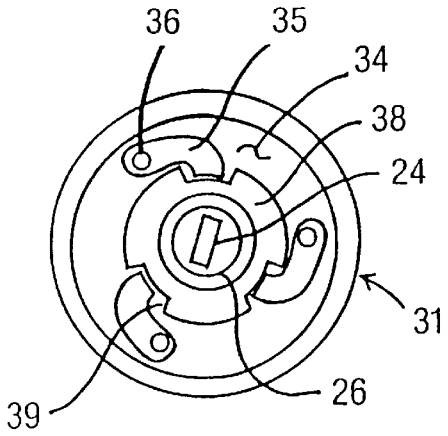
FIG. 5 (PRIOR ART)
FIG. 5 is a prior art ratchet pawl mechanism similar to that shown in FIG. 4.

Referring now to FIGS. 3–5, there is diagrammatically illustrated a conventional spring biased, ratchet/pawl arrangement supplied with conventional roller shade bar 20. In the arrangement illustrated, support tang 24 extends from or is made part of a spring rod 26 which extends some distance within roller shade bar 20 and has a slotted end 28. A longitudinally extending spring 30 fits over spring rod 26. One end of spring 30 fits into slotted end 28 while the other spring end 32 is affixed to roller shade bar 20, through a tensioning mechanism or tensioner 31 which is mounted to end cap 22 which in turn is press fitted onto roller shade bar 20. Because support tang 24 is non rotationally mounted in a bracket, spring rod 26 is stationary. Rotation of roller shade bar 20 thus tensions or compresses spring 30. Tensioner or tension mechanism 31 is typically in the form of a conventional ratchet pawl arrangement which permits shade 10 to be drawn, locked and released in the conventional manner.

Figure 8:
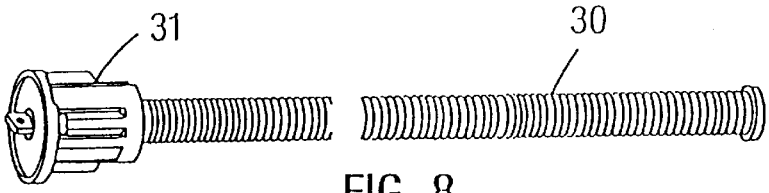
FIG. 8 is a conventional spring and spring tensioner used in the roller shade bar of the present invention.
Figure 7:
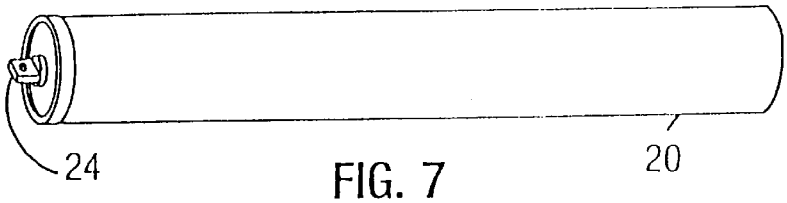
FIG. 7 is a perspective view of a roller shade bar used in the present invention.

Two typical, prior art ratchet pawl arrangements are shown in FIGS. 4 and 5 and both include a pawl plate 34 which carries pawl(s) 35 pivotally secured to pawl plate 34 by rivets 36. A ratchet plate 38 affixed to spring rod 26 has ratchet teeth 39 which mesh with pawls 35 to lock the shade in a drawn position with spring 30 tensioned and to permit the tension of spring 30 to conventionally rewind the shade fabric about roller shade bar 20 when pawls 35 are released from ratchet teeth 39. As is well known, to release pawls 35, roller support bar must be further rotated in the tensioning direction. In theory, an imperceptible motion of bottom rail 13 will result in release of pawls 35. In practice, and as is well known by anybody who has raised a window shade, some downward motion of the shade is required to cause release of the pawls. Because the invention is designed for use with upscale cellular and pleated shades, other conventional spring tensioner mechanisms can be used. In the preferred embodiment illustrated in FIGS. 7 and 8 a conventional Faber spring roller mechanism is shown. The Faber spring roller mechanism has conventional spring 30 with a tensioner 31 for tensioning and releasing the tension of spring 30 upon rotation of shade roller bar 20 in the conventional manner. The Faber tensioner 31 however uses bearings (not shown) in lieu of pawls which roll into and out of a raceway for locking and unlocking shade roller bar 20 to spring 30 upon shade rotation. The invention contemplates the substitution of other conventional spring and spring tensioner mechanisms in lieu of the ratchet pawl arrangement shown in FIGS. 4 and 5 or the bearing arrangement used in FIG. 8. For example, the conventional spring tensioning arrangement used in a spring actuated tape measuring device could be employed, i.e., tape measurers which "snap back" into the reel when the tape is initially pushed back into the case and not tape measurers which retract the tape when a button or lever is actuated. While such alternative spring actuated mechanisms may not necessarily require a further downward movement in bottom rail 13 to actuate the device, the consuming public will invariably pull bottom rail 13 downward to release shade 10. Again, roller shade bar 20 including end caps 22, and spring 30 and tensioner 31 disclosed is entirely conventional.

Referring now to FIG. 2, roller shade bar 20 can be a long length application and could comprise two standard size convoluted shade rollers with adjacent end caps removed and joined together by a spline 40. In such instance, support tip stud 23 from one window shade roller with its associated end cap 22 is removed while support tang 24 with its spring rod 26 and spring 30 of the adjacent window shade roller is removed so that roller shade bar 20 has at one end a support tip stud 23 and at its opposite end a support tang 24 as in a conventional window shade roller.

Figure 6:
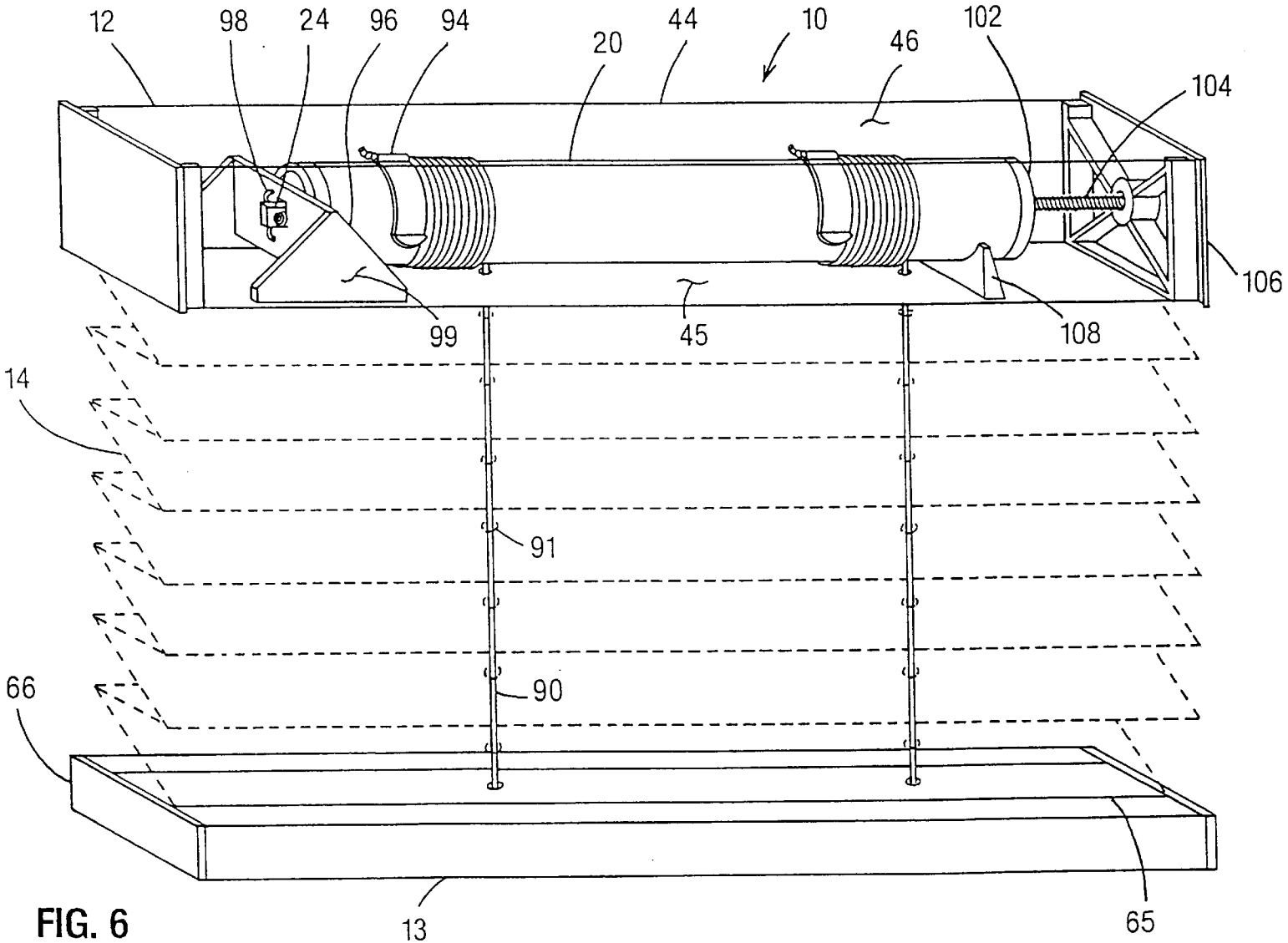
FIG. 6 is a perspective view of the cordless shade of the present invention.

Referring now to FIGS. 1, 2 and 6, head rail 12 is a low profile, completely self contained assembly carrying cordless window shade 10 and by which shade 10 is mounted to the frame of the window by conventional brackets (not shown) which mount to the window frame and can be attached to head rail 12 in any number of known mounting arrangements. Such mounting arrangements are well known by those skilled in the art and do not, per se, form part of the present invention and thus are not shown or described in further detail herein.

Head rail 12 includes an open ended, U-shaped, head rail extrusion 44 preferably formed from steel although it can be molded from aluminum or plastic. U-shaped extrusion 44 has a bottom base 45 from which vertically extend side rails 46 terminating at turned in or folded over top ends which form, at the top of each side rail 46, a channel or recess 48 extending the length of U-shaped extrusion 44.

Figure 10:
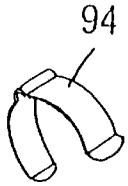
FIG. 10 is a perspective view of a cord clip used in the present invention.

In the parent invention shown in FIGS. 1 and 2, one end of U-shaped extrusion 44 is closed by a stud support end cap 49 and the opposite end of U-shaped extrusion 44 is closed by a tang support end cap 50. Stud support end cap 49 has a journal bearing for rotatably receiving support tip stud 23 of roller shade bar 20. Similarly, as best shown in FIG. 10, tang support end cap 50 has a slotted bracket 53 for receiving and holding in a non rotatable manner support tang 24 of roller shade bar 20. Each end cap 49, 50 has an appropriate bracing structure 54 which permits each end cap 49, 50 to simply snap into the open ends of U-shaped extrusion 44.

Referring still to FIGS. 1 and 2, bottom rail 13 is provided for attachment to the bottom of shade fabric 14. Bottom rail 13 includes an open ended, C-shaped bottom rail extrusion 65 which is closed at its ends once assembled to shade fabric 15 by end caps 66 which snap into place. A bottom support sleeve 68 typically made of a plastic material such as PVC, slides into a bottom sleeve pocket 69 formed at the bottom of shade fabric 15. Bottom support sleeve 68 is positioned within bottom sleeve pocket 69 and the shade assembled in a manner described below which includes attachment to a lift dowel 70. Bottom rail extrusion 65 is then slid over sleeve pocket 69 which contains support sleeve 68 thus closing the top of bottom rail extrusion 65 and encapsulating lift dowel 70 therein. End caps 66 are then snapped into place.

A top support sleeve 72 is likewise provided for insertion in a top sleeve pocket 73 at the top of shade fabric 15. In the preferred embodiment, double faced tape is used to secure top sleeve pocket 73 to the underside of head rail base 45. Alternately, top support sleeve 72 within top sleeve pocket 73 can, similarly to bottom support sleeve 68, slide into longitudinally extending edge channels extending downwardly from base 45 of head rail extrusion 44. In this manner, the top of shade fabric 15 is secured to head rail 12 and the bottom of shade fabric 15 is secured to bottom rail 13 and this is a conventional method or arrangement for attaching a cellular or pleated shade fabric to the head rail and bottom rail of a conventional, cord operated cellular shade.

Referring still to FIGS. 1–3, in the parent invention, the mechanism for raising and lowering shade 10 is accomplished by a lift tape 80 having a plurality of incrementally spaced lift holes 81 formed along its length. There are at least two lift tapes 80 provided for shade 10 and each lift tape extends through shade fabric 14 vis-a-vis a series of slits 83 formed therein. The bottom of each lift tape 80 is secured to bottom rail 13 and the top of each lift tape wraps about shade roller bar 20 vis-a-vis a spoke assembly 84 secured to roller shade bar 20. A plurality of circumferentially spaced, radially protruding spokes 85 extend from spoke assembly 84 which receive lift holes 81 as roller shade bar 20 is rotated to precisely insure that bottom rail 13 is maintained parallel to head rail 12 irrespective of the shade position and no matter how the shade is abused in use.

The preferred embodiment of the present invention is shown in the general arrangement illustrated in FIG. 6 and where applicable, the reference numerals used in describing the shade components of the parent invention will also be used in describing the shade components of the present invention. In cordless window shade 10 of FIG. 6, shade fabric 14 is shown in dotted form and comprises a pleated shade fabric. The pleated shade fabric operates in the same fashion as the cellular shade fabric described with reference to FIGS. 1–2 in that when the shade is fully raised, shade fabric 14 folds itself into nested plies and expands in an accordion like manner from the top when bottom rail 13 is moved down. As the shade is drawn, pleated shade fabric plies 16 initially adjacent head rail 12 expand. If the shade fabric 14 is properly sized to the window opening, a fully drawn shade 10 will have its lower most plies adjacent bottom rail 13 somewhat expanded.

Figure 14:
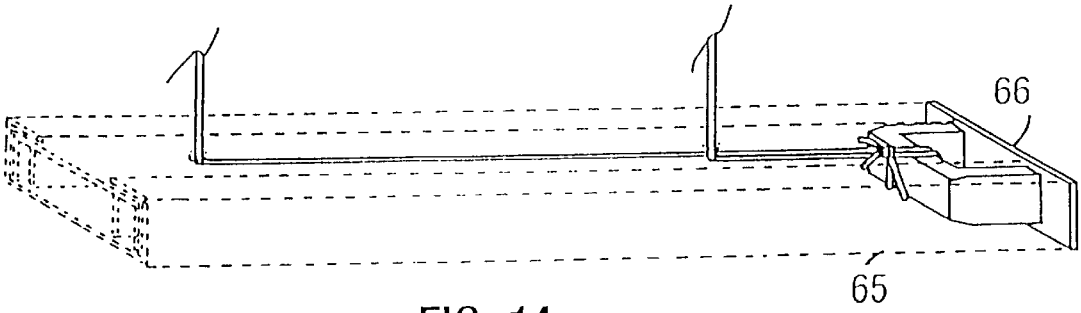
FIG. 14 is a pictorial representation of an end cap used in the bottom rail of the present invention.

In the preferred embodiment, lift cords 90 extend through cord openings 91 is for raising and lowering bottom rail 13 relative to head rail 12. Thus, the lift tape slits in the parent invention are replaced by the smaller cord openings 91 in the present invention. The bottom of each lift cord 90 is permanently tied to bottom rail 13 in any appropriate manner. One arrangement illustrating such a tie is disclosed in FIG. 14. The top of each lift cord 90 is wrapped about shade roller bar 20 thus obviating the spoke assembly of the parent invention and especially configured capstans or pulleys of the prior art. Further wrapping lift cords 90 directly about shade roller bar reduces the depth of the head rail profile.

Any conventional mechanism can be used to attach lift cords 90 to shade roller bar 20. In the preferred embodiment, cord clips 94, prospectively illustrated in FIG. 10, simply snap on to shade roller bar 20 as shown in FIG. 6. The width of cord clip 94 coupled with at least one wrap of lift cord 90 about shade roller bar 20 provides an easy mechanism for initially installing and adjusting bottom rail 13 relative to top rail 12. Importantly, should shade 10 need to be adjusted after installation, cord clips 94 permit such adjustment.

Figure 11:
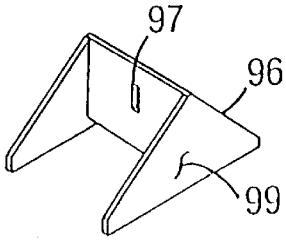
FIG. 11 is a perspective view of a lock slide bracket.
Figure 12:
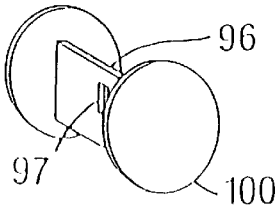
FIG. 12 is a perspective view of an alternative embodiment of the lock slide bracket shown in FIG. 11.

In the preferred embodiment, support tang 24 extending from tensioner 31 is affixed to a movable support 96. Movable support 96, illustrated in perspective in FIG. 11, has a slotted opening 97 through which support tang 24 extends and is affixed to movable support 96 by any suitable means such as a cotter pin 98. In the preferred embodiment, movable support 96 has two triangular legs 99 which travel along bottom base 45 of head rail 12. In an alternative embodiment illustrated in FIG. 12, triangular legs 99 can be replaced by rolling wheels 100. In either embodiment, slotted opening 97 fixes support tang 24 from rotating in the same manner that slotted bracket 53 in head rail end cap 50 prevented support tang 24 from rotating in the parent invention. Movable support 26 permits shade roller bar 20 to longitudinally move along bottom base 45 within head rail 12.

Figure 9:
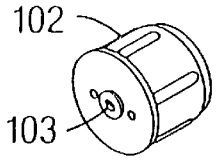
FIG. 9 is a perspective view of a screw tapped plug used in the roller shade in FIG. 7.
Figure 13:
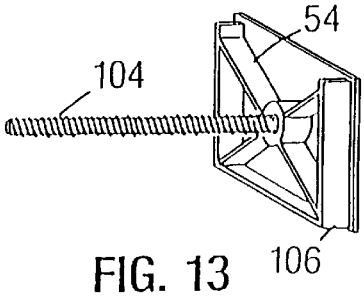
FIG. 13 is a perspective view of the head rail end cap lead screw.

Fitted into the end of shade roller bar 20 opposite to the end containing spring 30 and tensioner 31 is a screw tapped end plug 102 having a threaded opening 103 as shown in FIG. 9 for threadingly engaging the threads of a lead screw 104 permanently affixed to a screw guide end bracket 106, as shown in FIG. 13, of head rail 12. Lead screw 104 is non-rotatably and permanently affixed to screw guide end bracket 106. Thus, rotation of shade roller bar 20 in one direction will cause lead screw 104 to advance into screw tapped end plug 102 and draw roller shade bar 20 along with movable support 96 towards screw guide end bracket 106 while rotation of roller shade bar 20 in the opposite direction will cause lead screw 104 to advance out of screw tapped end plug 102 increasing the distance of roller shade bar 20 from screw guide end bracket 106. An additional support 108 is provided for roller shade bar 20 adjacent screw tapped end plug 102. The presence and positioning of additional supports 108 is somewhat optional and depends on the length of roller shade bar 20.

Importantly, the thread pitch of lead screw 104 is dimensioned relative to the circumference of shade roller bar 20 considering the thickness of lift cords 90 so that lift cords 90 wrap and unwrap themselves singularly or in a non-overlying manner about the circumference of shade roller bar 20. Lift cords 20 will always wrap spirally about roller shade bar 20 because of the thread pitch of lead screw 104. So long as lift cords 90 do not wrap themselves about one another, a consistent, repeatable positioning of bottom rail 13 will result.

A conventional roller shade bar in its standard sizes of about 1" in diameter has a relatively large circumference. This 1" diameter does not increase the depth or the height of head rail 12 when compared to existing cord operated shade mechanisms. If anything, a lower profile results. At the same time, a relatively large diameter of shade roller bar 20 results in fewer turns or wraps of lift cords about the roller shade bar to raise and lower shade 10. Fewer wrapping turns means then that the movement of roller shade bar 20 within head rail 12 is minimal and thus a relatively long roller shade bar 20 when compared to the overall width of shade fabric 14 can be used in the invention. Tensioning spring 30 has a length of about 9" and it is desired that tensioning spring 30 be positioned within roller shade bar 20 in the conventional manner to minimize head rail profile. Because of the limited movement of roller shade bar 20 within head rail 12, relatively narrow window openings can be covered with the shade of the present invention. A more subtle benefit results simply from the fact that less movement of roller shade bar 20 tends to promote trouble free operation of shade 10 during the life of the shade.

The Reel-Ease Shade Lift

A) The Reel-Ease relates to the raising and lowering of pleated and cellular fabric shades without the use of conventional cords or pulls or locks.

This system allows for the operation of the shade in much the same manner one would activate a conventional spring roller shade. With a gentle pull of the bottom rail, the shade can be extended and parked at a desired length. A downward pull thereon will release the engaged spring roller pawl from the ratchet wheel and spring tension will draw the bottom rail up until manually checked or in the fully raised position.

The Reel-East addresses four problems:

1) Safety. The invention eliminates the danger of having a child caught in or strangled by a hanging control cord.

2) Convenience. Often control cords are wrapped around cord cleats after the shade is adjusted. Wrapping the cords keeps it from hanging down to the floor but takes extra time and effort.

3) Aesthetics. Many people find cords handing down detract from the decorative function of pleated or cellular fabric. The Reel-Ease eliminates the controls that create a vertical distraction to the horizontal pleats of these fabrics.

4) Consistent Alignment. Traditional shades with lock mechanisms regularly go out of alignment, making for an uneven bottom rail. The Reel-Ease stays even at all times.

B) It is an object of the presently described invention to permit cords to uniformly wrap themselves around a self contained spring roller bar, in a consistent and predetermined manner.

The Reel-Ease utilizes a Spring Roller Bar in conjunction with a Screw Guide to thread itself along without releasing its preset tension. This is accomplished by accommodating the preset spring roller bar with a Spring Lock Slide, Screw Taped End Plug and corresponding Screw Guide End Bracket.

C) The tension of the spring roller is preset by turning the Tang of the spring mechanism clockwise until a resistance is achieved, proportionate to the weight of Fabric and Bottom rail to be lifted.

The spring end of the roller bar is affixed to the Slide Bracket via cotter pin, through the predrilled tang of the spring roller mechanism. The screw tapped end plug replaces the pin end plug of conventional spring roller bars. This tapped end plug is inserted in the roller bar opposite the spring mechanism, to accommodate a threaded shaft on the screw guide end cap. The threads per inch on this shaft dictate the distance the spring roller will traverse as it rotates.

The ratios of rotation to traversing distance provide a measurable and uniform wrap to a set of cords fastened to the roller bar. These cords replace the fabric of conventional roller shades for physically activating the spring roller bar. The cord length is calculated by adding the shades predetermined length plus width and an additional 12" which will be referred to as the overextending activation length. Cord clips are used to fasten the cords to the roller bar coinciding with the cord guide openings drilled into the bottom of the head rail.

Location of the cord guide openings are typically equidistant from each end and centered in the depth of the head rail. Conversantly with the cord guide strip and the top of the compressed pleated or cellular fabric. With all guide holes aligned, the fabric is adhered to the underside of the head rail and the cord guide strip to the bottom of the fabric. With the cords clipped to the roller bar the opposite ends are threaded through the inside of the head rail cord guide openings, through the compressed fabric, and exit the guide strip.

Before the spring roller system is placed into the head rail the roller system is rotated clockwise in relation to the spring end. This manual rotation wraps the cords around the roller bar approximately three time for the spring rollers initial activation. The complete spring roller system is now placed inside the head rail and secured by a snug fit of the screw guide bracket sleeve into the open end of the head rail. The head rail end cap is attached in the same manner completing the Reel-Ease head rail system.

With the fabric compressed to the underside of the head rail the cords are gently pulled together, parallel to the head rail, to be secured to the bottom rail end cap. The cord exiting the guide opening furthest from the direction the set is pulled will appear shortest. All other cords are cut to be made even with this cord and jointly secured to the inside of the Bottom Rail End Cap.

The bottom rail is sleeved over the cord guide strip with the cords exiting the opposite end. With a sufficient tug on the cords, the spring roller will activate. This will then guide the cords through the enclosed open channel of the cord guide strip, through the fabric, into the head rail, and uniformly wrapping around the roller bar until the bottom rail end cap seats itself into the open end of the bottom rail. Closing the other end of the bottom rail with a second end cap completes the shade's assembly.

An additional feature of the Reel-Ease system is a reduction of the minimum shade width from 16", found in most clutch activated systems, to approximately 12". Wrapping cords onto a 1" diameter spring roller bar versus a ⅜" diameter shaft in the clutch system will require less than half of the traversing distance within the head rail. Multiplying each of these diameters by pi or 3.1416 will provide their circumference. This calculation clarifies that it takes only 1.0 revolution of the Reel-Ease System to raise the shade 3.1416" in comparison to the 2.6166 revolutions to raise the clutch system the same height. It is this reduced traversing distance in the Reel-Ease system that allows for a narrower minimum shade width.

Two additional claims for the Reel-Ease system include the use of a Splice in joining two roller bars in a shade exceeding stock roller bar lengths. Also, using a roller bar support at a spliced location and possible under the screw tapped end plug side of the roller bar.

D) Past inventions state the use of spring rollers in conjunction with Venetian blinds. However, the short comings of this combination become apparent when the activation of the spring is rendered impossible when blind is parked in the fully extended finished blind length. The Reel-Ease system addresses this problem by utilizing the accordion fold characteristics of pleated or cellular fabrics in conjunction with the overextending activation length. This permits the activation of the spring roller beyond the shades predetermined finished shade length.

Unlike conventional Venetian blinds, the weight of pleated or cellular fabric are more in-line with traditional roller shade fabrics.

Prior inventions make claim to the importance of cords wrapping uniformly to provide a level bottom rail and the elimination of pull cords for safety reasons. We believe the Reel-Ease system can cost effectively meet the above criteria for both commercial and residential applications.

The present invention is a duplicate of state-of-the art cord drawn shades in that, to the consumer, each type of shade will look like one another except that one will have cords and one will not. Both shades will have a lift means extending through their pleated fabrics and both will be adjustable, during and after installation. Both types of shades will give trouble free operation over the life of the shade and both will maintain the bottom rail parallel to the head rail. However, the cost of the shade of the present invention will be materially reduced when compared to the cord drawn shades. More importantly there are no dangerous lift cords.

The invention has been described with reference to a preferred embodiment. Obviously, alterations and modifications will become apparent to those skilled in the art upon reading and understanding the detailed description of the invention set forth above. It is intended to cover all such modifications and alterations insofar as they come within the scope of the present invention.

Having thus defined the invention, it is claimed:

1. A cordless shade for a window opening which is manually actuated without a pull cord extending from the top of the shade, said cordless shade comprising:

a) a head rail containing a bar, said bar having at one end thereof a spring and a spring tensioning mechanism tensioning said spring upon bar rotation in one direction and releasing spring tension upon opposite bar rotation, said releasing accomplished by applying a force rotating said bar in said one direction;

b) a bottom rail adapted to be raised and lowered relative to said top rail for drawing and releasing the shade;

c) a cellular shade fabric extending between said head and bottom rails for covering said window, said shade fabric having a cross-sectional polygonal cellular configuration which is collapsible into a plurality of vertically stacked, extendible fabric plies nested between said head rail and said bottom rail when said shade is raised and extendible to a first position when the shade is fully lowered;

d) at least first and second longitudinally spaced openings extending through said fabric from the bottom to the top of said fabric;

e) at least two lift cord segments, each extending from said bottom rail and through said fabric openings for raising and lowering said bottom rail relative to said top rail; and f) a wrap mechanism associated with said bar and said lift cords to assure that said lift cords uniformly and in unison with one another wrap around said bar in a circumscribing manner as said shade is raised and lowered while said bottom rail remains parallel with said head rail.

2. The shade of claim 1 wherein said spring extends longitudinally and generally parallel to the length of said head rail and is compressed when said shade is lowered.

3. The shade of claim 2 wherein said bar is a roller shade bar having said spring longitudinally extending therein.

4. The shade of claim 1 wherein said wrap mechanism includes a translating mechanism for allowing longitudinal movement of said bar relative to and along the length of said head rail as said cords are wound and unwound in a lengthwise manner around said bar, said bar being shorter in length than said head rail.

5. The shade of claim 1 wherein said cross-sectioned configuration of said shade fabric includes a plurality of polygonal shapes extending in a sequence for the length of the shade, and the cord length is such that the polygonal shape of the cellular shade can be further extended after the shade is fully drawn by downward movement of said head rail to allow said shade to be withdrawn by said spring.

6. A cordless shade for a window opening which is manually actuated without a pull cord and the like extending from the top of the shade, said cordless shade comprising:

a) a head rail containing a bar, said bar having at one end thereof a spring and a spring tensioning mechanism tensioning said spring upon bar rotation in one direction and releasing spring tension upon opposite bar rotation, said releasing accomplished by applying a force rotating said bar in said one direction, said bar shorter in length than said head rail, said bar attached at one of its ends to an adjacent head rail end;

b) a bottom rail adapted to be raised and lowered relative to said top rail which is the only part of the shade used to manually lower and release said shade when said shade is raised;

c) a shade fabric extending between said head and bottom rails for covering said window, said shade fabric having a cross-sectional configuration which is collapsible when the shade is raised and extendible to a first position when the shade is fully lowered;

d) at least first and second longitudinally spaced openings extending through said fabric from the bottom to the top of said fabric;

e) first and second lift cords extending from said bottom rail through said first and second fabric openings, respectively, for raising and lowering said bottom rail relative to said top rail; and f) a wrap mechanism for securing said lift cords to said bar so that said lift cords wrap about said bar as said shade is raised and lowered, said wrap mechanism including i) a lead screw affixed to a first end of said bar permitting said bar to move longitudinally within said head rail in a first direction upon clockwise rotation of said bar and in a second, opposite longitudinal direction upon counter clockwise rotation of said bar; and ii) a support associated with said bar and said head rail for supporting said opposite end of said bar in a movable manner while permitting said spring tensioning mechanism to tension said spring and release said spring tension upon lowering and raising of said bottom rail.

7. The shade of claim 6 wherein said cross-sectioned configuration of said shade fabric includes a plurality of polygonal shapes extending in a sequence for the length of the shade, and the cord length is such that the polygonal shape of the cellular shade can be further extended after the shade is fully drawn by downward movement of said head rail to allow said shade to be withdrawn by said spring.

* * * * *